US007874896B1

(12) United States Patent
Watson

(10) Patent No.: US 7,874,896 B1
(45) Date of Patent: Jan. 25, 2011

(54) SHARPENING GUIDE ASSEMBLY

(75) Inventor: Stanley A. Watson, Franklin, MA (US)

(73) Assignee: Vogel Capital Inc., Marlborough, MA (US)

( * ) Notice: Subject to any disclaimer, the term of this patent is extended or adjusted under 35 U.S.C. 154(b) by 562 days.

(21) Appl. No.: 11/974,278

(22) Filed: Oct. 12, 2007

Related U.S. Application Data

(60) Provisional application No. 61/851,838, filed on Oct. 12, 2006.

(51) Int. Cl.
*B24B 1/00* (2006.01)
*B24B 19/00* (2006.01)

(52) U.S. Cl. ..... 451/45; 451/371; 451/380; 451/524; 451/557

(58) Field of Classification Search ..... 76/81.1, 76/82, 82.2, 88; 451/45, 367, 369, 370, 380, 451/371, 419, 524, 555, 557, 558
See application file for complete search history.

(56) References Cited

U.S. PATENT DOCUMENTS 1,172,569 A * 2/1916 Shearfor ..... 451/557
2,557,093 A * 6/1951 Garbarino ..... 76/82.2
3,819,170 A * 6/1974 Longbrake ..... 269/3
D273,081 S * 3/1984 Levine ..... D8/93
4,441,279 A * 4/1984 Storm et al. ..... 451/175
4,538,382 A * 9/1985 Johannsen ..... 451/175
4,714,239 A * 12/1987 LeVine ..... 269/3
4,777,770 A * 10/1988 LeVine ..... 451/557
5,363,602 A * 11/1994 Anthon et al. ..... 451/540
5,725,415 A * 3/1998 Bernhard ..... 451/45
6,579,163 B1 * 6/2003 Ross et al. ..... 451/545

* cited by examiner

*Primary Examiner*—Timothy V Eley
(74) *Attorney, Agent, or Firm*—K&L Gates LLP

(57) ABSTRACT

A sharpening guide assembly to be removably attached to a sharpening stone to provide for smooth, controlled and accurate motion when sharpening a blade is provided. The assembly includes a body portion forming a platform adapted to receive the sharpening tool. A magnet is disposed within a recess formed in the platform. The magnet aids in removably attaching the sharpening tool to the guide assembly. The body portion includes guide rails to stabilize and aid in the attachment of the sharpening tool to the guide assembly. A guide rod is affixed to the body portion. The sharpening guide assembly may be used with a sharpening tool including metal and having a substantially planar sharpening surface. A clamping device for holding a blade to be sharpened is slidably coupled to the guide rod of the assembly and is drawn back and forth along the guide rod for sharpening the blade.

19 Claims, 4 Drawing Sheets

SHARPENING GUIDE ASSEMBLY

CROSS REFERENCE TO RELATED APPLICATIONS

This application claims the benefit of U.S. Provisional patent application No. 60/851,838 filed, Oct. 12, 2006, the entire disclosure of which is incorporated herein by reference.

FIELD OF INVENTION

The invention relates to a sharpening guide assembly and, in particular, a magnetic knife sharpening guide rod accessory for use with a sharpening tool.

BACKGROUND

The use of handheld tools to sharpen blades can be ineffective and dangerous. Running a blade across a sharpening tool such as a whetstone requires precision and due care so as not to damage the blade, or worse, to cause severe injury to the user of the tool. To effectively sharpen a blade using a stone, the user must run the blade back and forth repeatedly across the stone on an even plane. Running the blade at even a slight angle off the plane of the stone can reduce the effectiveness of the sharpening and can even cause damage to the blade. Uncontrolled human motor skills can also lead to inconsistent motion in running the blade back and forth. Without a fixed guide, or brace, the user is prone to make inconsistent and uneven motions. Additionally, a user may slip or lose control of the blade being sharpened. Such a loss of control can lead to the users being injured with cuts, scrapes and other lacerations. What is needed, therefore, is a sharpening guide assembly, which is affixable to a sharpening tool to aide in control and repetitive guided motion of the blade.

SUMMARY OF THE INVENTION

Aspects of the present invention include a sharpening guide assembly that, when used in conjunction with a sharpening tool, provides smooth, safe and guided control.

One embodiment of the invention includes a sharpening guide assembly for sharpening a blade, held in a device, with a sharpening tool including metal and having a substantially planar sharpening surface. The assembly includes a body portion adapted to receive the sharpening tool and a magnet disposed within the body portion for removably coupling the body portion to the sharpening tool. A rod having a top edge is fixedly attached to the body portion and the top edge of the rod is substantially parallel to the planar sharpening surface of the sharpening tool. The rod is arranged such that the device is slidably coupled to the rod whereby the device is slidable along the rod such that the angle of the blade with respect to the planar sharpening surface is substantially constant when the device is moved along the rod and the blade is moved across the planar sharpening surface.

Another embodiment includes a sharpening guide assembly for sharpening a blade with a sharpening tool including metal and having a substantially planar sharpening surface in which the assembly comprises a body portion adapted to receive the sharpening tool and a magnet disposed within the body portion for removably coupling the body portion to the sharpening tool. The assembly also includes a rod having a top edge, in which the rod is fixedly attached to the body portion. The top edge of the rod is substantially parallel to the planar sharpening surface of the sharpening tool. A clamping device for holding the blade is slidably coupled to the rod whereby the clamping device is slidable along the rod such that the angle of the blade with respect to the planar sharpening surface is substantially constant when the clamping device is moved along the rod and the blade is moved across the planar sharpening surface.

Yet another embodiment includes a method of sharpening a blade with a sharpening tool including metal and having a substantially planar sharpening surface. The method includes removably coupling a rod to the sharpening tool by a magnet. The rod has a top edge arranged to be substantially parallel to the planar sharpening surface of the sharpening tool. The blade is disposed in a device for holding the blade and the device is slidably coupled to the rod, whereby the device is slidable along the rod such that the angle of the blade with respect to the planar sharpening surface is substantially constant when the device is moved along the rod.

BRIEF DESCRIPTION OF THE DRAWINGS

These embodiments and other aspects of this invention will be readily apparent from the detailed description below and the appended drawings, which are meant to illustrate and not to limit the invention, and in which.

DETAILED DESCRIPTION

Figure 1D:
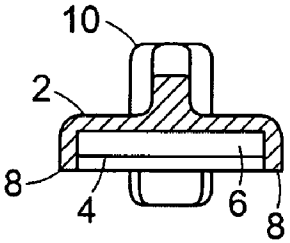
FIGS. 1A-D are schematic diagrams of the body portion of the sharpening guide assembly of the present invention.

The invention will be more completely understood through the following detailed description, which should be read in conjunction with the attached drawings. Detailed embodiments of the invention are disclosed herein, however, it is to be understood that the disclosed embodiments are merely exemplary of the invention, which may be embodied in various forms. Therefore, specific functional details disclosed herein are not to be interpreted as limiting, but merely as a basis for the claims and as a representative basis for teaching one skilled in the art variously to employ the invention in virtually any appropriately detailed embodiment.

Embodiments of the invention include a sharpening guide assembly to be removably attached to a sharpening tool to provide for smooth, controlled and accurate motion when sharpening a blade or other object such as a knife. Turning to FIGS. 1A-D, cross sectional views of a body portion 2 of a sharpening assembly are depicted in accordance with an embodiment of the invention. The assembly includes a body 2 portion forming a platform 4, which is adapted to receive a sharpening tool, i.e., an end portion of the sharpening tool. A recess is formed within the platform for placement of a magnet. The magnet aids in removably attaching the sharpening tool to the platform 4. FIG. 1A shows a cross-section from one side view of the body portion 2 of the assembly. In one embodiment the body includes a guide rail 8 formed adjacent to platform 4 to stabilize and aid the attachment of the sharpening tool to the assembly. The sharpening guide assembly may be used with a sharpening tool having a substantially planar sharpening surface and a metal component. For example, the sharpening tool may be the DMT® Double Sided Diafold® having a diamond abrasive surface, available from Diamond Machining Technology, Marlborough, Mass.

The sharpening guide assembly body portion 2 may be formed from injection molded plastic. The platform 4 may further include side and end guide rails 8, which may be formed, e.g., by molding, on the top portion of the platform 4 to receive an end portion of the sharpening tool. The side and end guide rails 8 serve to stabilize the assembly's position during the sharpening process and further ensure repeatable positioning each time the assembly is attached to the sharpening tool. An end portion 10 provides a coupling to a rod (not shown) which, as explained below, provides stability and controlled guidance for the sharpening motion.

Figure 1C:
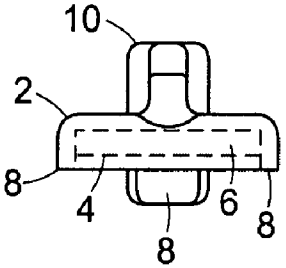
Figure 1A:
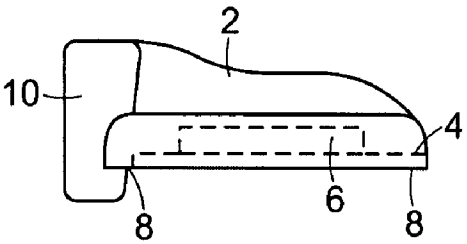
Figure 1B:
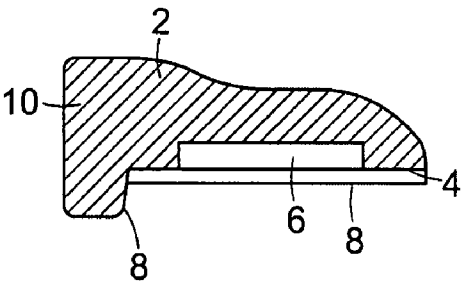

FIG. 1B provides an alternate depiction of the side view of the assembly in accordance with an embodiment of the invention. The assembly body, molded as one piece to include the guide rail 8 and end portion 10, is shown in the shaded region. The body defines the platform 4 and a recess 6.

FIGS. 1C and 1D depict a cross section the assembly body from an end-on view. The guide rail 8 on both sides and rear of the platform provide a bordered frame into which the sharpening tool is removably attached.

Figures 2A, 2B, 2C:
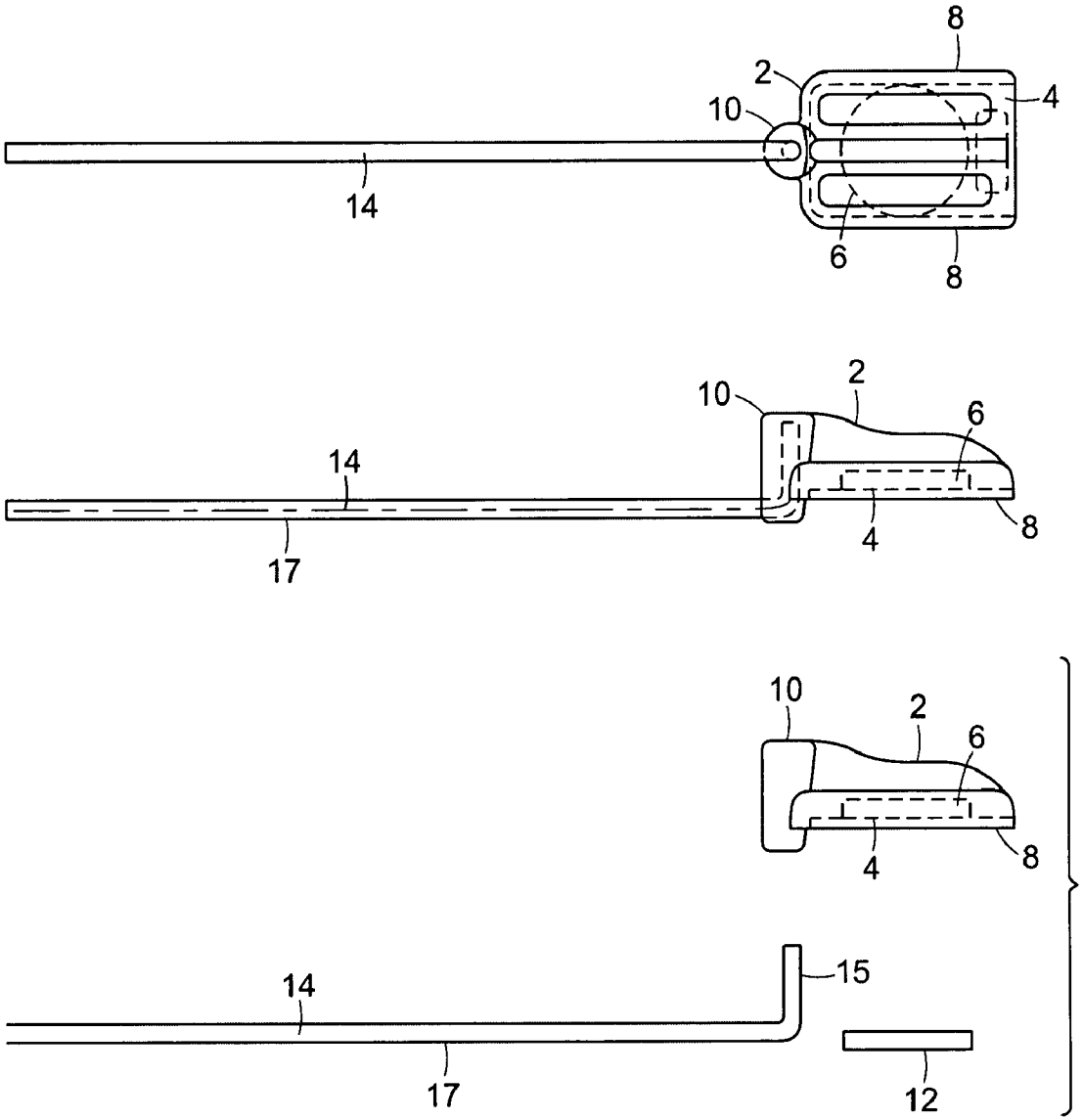
FIGS. 2A-C are schematic diagrams of the body portion and guide rod components.

FIGS. 2A-C depict a sharpening guide assembly in accordance with an embodiment of the invention. A guide rod 14, such as a stainless steel rod, may have a molded or otherwise bent end portion 15, which is adapted to be inserted into and fixedly held by a receiving section or slot of the end portion 10 of the platform 4. The guide rod 14 is positioned such that a top edge 17 of the rod is substantially parallel to the planar sharpening surface. In one embodiment the top edge 17 of the rod lies in the same plane (i.e., coplanar) as the planar sharpening surface of the sharpening tool (not shown).

The platform 4 is removably attachable to the sharpening tool, in particular to the metal component, by a magnet 12, e.g., a Neodymium Iron Boron rare earth magnet. The magnet 12, in one embodiment, is held in position within molded recess 6 in a portion of the platform 4 by a two-component epoxy resin. While the embodiments described herein refer to a Neodymium Iron Boron magnet, one skilled in the art should recognize that any magnet, including rare earth magnets may be implemented without deviating from the scope of the invention. Further, one skilled in the art should recognize that any mechanism of attachment of the magnet to the body may be implemented including, but not limited to, epoxy, molding, friction fit etc., without deviating from the scope of the invention.

FIG. 2A depicts the parts of the assembly prior to their combination. In FIG. 2B, the magnet 12 has been affixed to the body 2 within the recess 6 of the platform 4. The end portion of the guide rod 15 is inserted into the receiving portion of the end portion 10 of the body portion 2. As seen in FIG. 2B, when assembled according to one embodiment, the top edge 17 of the guide rod 14 is substantially coplanar to the plane where a top surface of the sharpening tool would be located (see FIG. 3). FIG. 2B depicts a top view of the assembly with the magnet 12 and the guide rod 14 affixed to the body portion 2.

While the embodiments of FIG. 2 depict the top edge of the rod as coplanar with the plane of the sharpening surface, embodiments of the invention may be implemented in which the top edge of the rod is parallel to the plane of the sharpening surface and not coplanar. The embodiments described herein should not be construed as limiting the scope of the invention to require coplanarity of the top edge of the rod with the plane of the sharpening surface.

Figure 3:
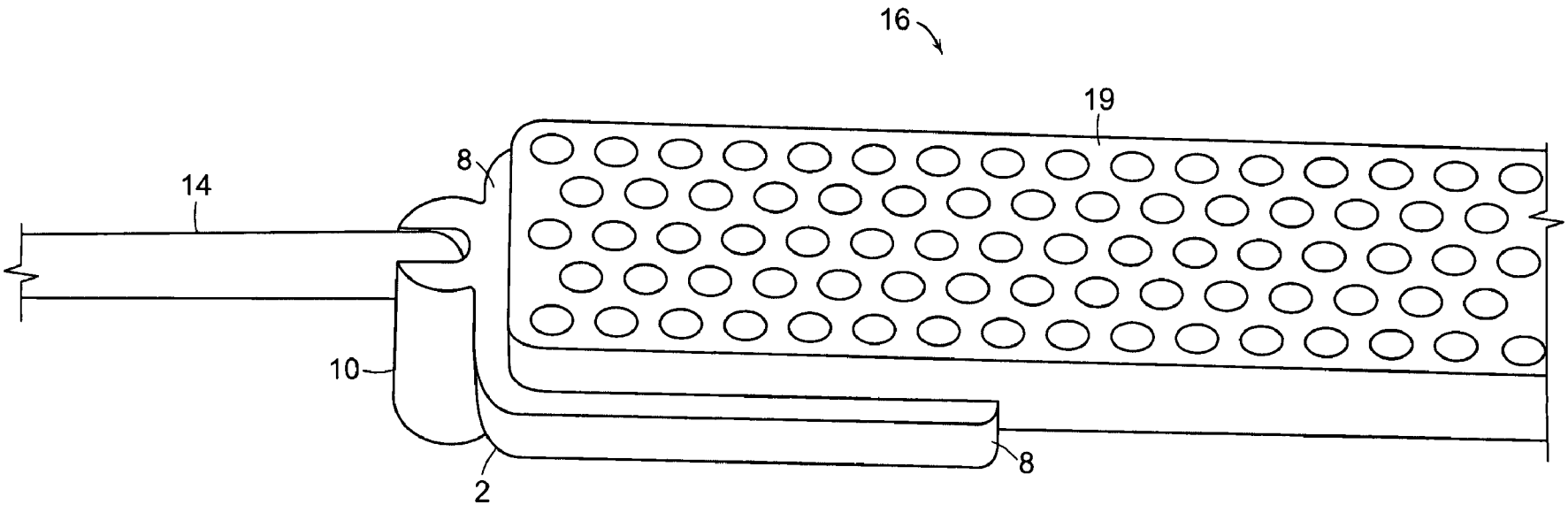
FIG. 3 is a diagram of the body portion and guide rod components as attached to a sharpening tool.

Turning now to FIG. 3, a guide assembly coupled to a sharpening tool is depicted in accordance with an embodiment of the invention. A sharpening tool 16 includes a substantially planar metallic surface 19, which may include embedded diamond particles capable of sharpening a blade. The sharpening guide assembly is attached to the sharpening tool by the magnetic force between the magnet and the metal of the surface 19 of the sharpening tool 16. In one embodiment, the sharpening tool includes a metallic surface on a top and bottom surface of the tool. The metallic surface 19 of the top surface provides the sharpening surface, while the bottom surface provides the metallic attractant to the magnet. Guide rails 8 border the edge of the tool 16 to prevent the tool from sliding or otherwise dislodging from the assembly during sharpening. Guide rod 14 is affixed to the body 2 of the assembly through the end portion 10.

Figure 4:
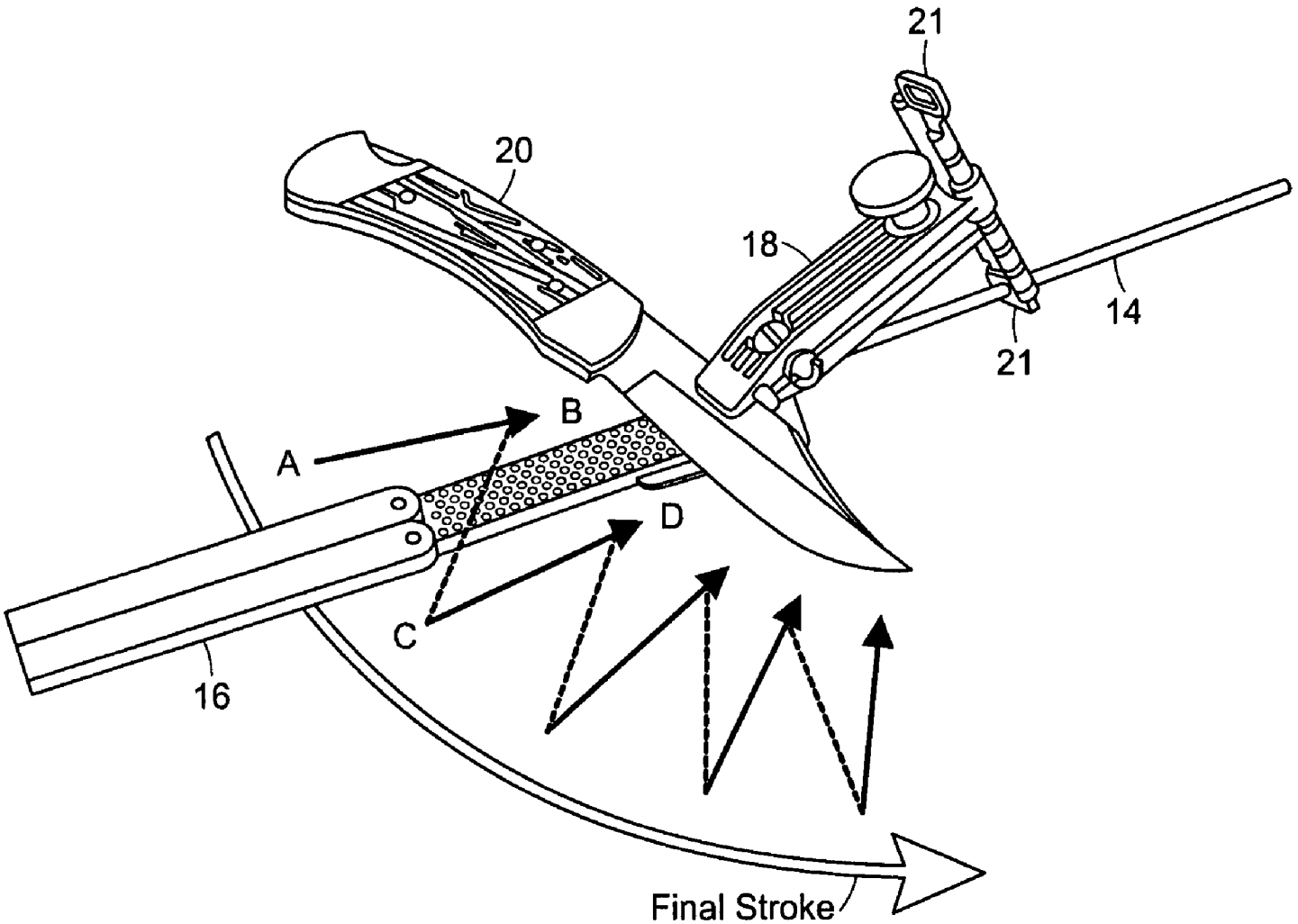
FIG. 4 is a diagram of the body portion and guide rod components as attached to a sharpening tool and including a clamping device holding a knife.

In one embodiment, the platform 4 and guide rod 14 assembly is used with a clamp 18 capable of holding an object 20 to be sharpened, e.g., a knife, as depicted in FIG. 4. For example, the clamp 18 may be the DMT® Aligner™ knife clamp available from Diamond Machining Technology, Marlborough, Mass. The clamp 18 is adapted to slide back and forth along the guide rod 14 and to hold the object 20 to be sharpened to slide back and forth along the substantially planar sharpening surface 19 of the sharpening tool 16.

In one embodiment the clamp includes an angle adjustment rod 21, which assists in establishing a fixed angle between the clamp and the sharpening tool. The angle adjustment rod 21 includes a loop or other opening that may be slidingly engaged with the guide rod 14. The adjustment rod 21 can engage and lock its position with the clamp to provide a fixed angle. In one embodiment the adjustment rod 21 includes a groove running the length of the rod. The groove is engaged with a notch formed on the clamp and adjusted until the adjustment rod 21 reaches the desired position. The adjustment rod 21 may then be locked by twisting the rod such that the notch from the clamp enters an alignment recess adjacent to the groove. When the adjustment rod 21 is turned and locked, the loop is substantially perpendicular to the length of the clamp, which is coplanar with the blade.

The adjustment rod 21, in one embodiment, contains a plurality of alignment recesses adjacent to the groove to provide a variety of fixed angles. The height of the angle may be dependent upon the size and type of blade to be sharpened. For example, blades such as razor blades, craft, fillet paring and trimming knives may require a lower sharpening angle. Blades such as meat cleavers, machetes, brush knives, military and survival knives may require a higher sharpening angle. Blades from boning, carving, chef, pocket and other folding knives may require a medium-low angle, while fixed blade knives, such as hunting knives and larger sporting knives may require a medium-high angle. In one embodiment, it is contemplated that the adjustment rods 21 may have up to seven (7) or more fixed angle settings.

In use, the platform 4 is attached to an end portion of the sharpening tool 16 using the magnet 12 and positioned by the side and end guide rail 8. The guide rod 14, in one embodiment, is attached to the platform 4 by inserting the molded or bent portion 15 into the receiving section 10 of the platform 4 such that a free end of the guide rod 14 extends away from the end portion of the sharpening tool 16. A clamp 18, into which an object 20 to be sharpened has been properly positioned and held, is placed onto the free end of the guide rod 14. In one embodiment, the clamp 18 may be coupled to the guide rod 14 through a loop opening on the clamp 18. The clamp 18 is then moved back and forth along the guide rod 14 (along directional arrows from points A, B, C and D) so that the object 20 to be sharpened contacts the planar sharpening surface 19 of the sharpening tool 16, for the purpose of sharpening same.

Beginning at point A, the sharpening tool is slid to point B using light pressure. The sharpening tool us then moved to point C and a stroke is repeated to point D. Similar strokes are repeated until the blade achieves the desired sharpness. A final rounded stroke may be used to provide a clean and uniform edge. Alternatively, the sharpening tool 16 may be drawn back and forth while the clamp 18 is stabilized in order to sharpen the object 20. Upon completion of the sharpening procedure, the components of the sharpening guide assembly may be removed from the sharpening tool 16. The blade may then be turned over to repeat the process for the other side of the blade. In one embodiment, the clamp may include two oppositely configured adjustment rods 21. Both rods are locked into the corresponding fixed angle heights and when one side of the blade is completed, the entire clamp assembly may be turned over, eliminating the need to remove the blade from the clamp or otherwise changing the assembly.

While embodiments of the invention describe a clamping device with a loop feature for slidably coupling the clamp to the guide assembly, one skilled in the art should recognize that any grasping mechanism suitable to hold an object to be sharpened may be utilized without deviating from the scope of the invention. Further, the clamp or grasping mechanism may be coupled to the guide rod using any coupling mechanism known in the art, e.g., a clamp, a clip, or a friction fit device.

While the invention has been described with reference to illustrative embodiments, it will be understood by those skilled in the art that various other changes, omissions and/or additions may be made and substantial equivalents may be substituted for elements thereof without departing from the spirit and scope of the invention. In addition, many modifications may be made to adapt a particular situation or material to the teachings of the invention without departing from the scope thereof. Therefore, it is intended that the invention not be limited to the particular embodiment disclosed for carrying out this invention, but that the invention will include all embodiments falling within the scope of the appended claims. Moreover, unless specifically stated any use of the terms first, second, etc. do not denote any order or importance, but rather the terms first, second, etc. are used to distinguish one element from another.

What is claimed is:

1. A method of sharpening a blade with a sharpening tool including metal and having a substantially planar sharpening surface, the method comprising:

removably coupling a rod to the sharpening tool by a magnet, the rod having a top edge arranged to be substantially parallel to the planar sharpening surface of the sharpening tool;

disposing the blade in a device for holding the blade; and slidably coupling the device holding the blade to the rod, whereby the device is slidable along the rod such that the angle of the blade with respect to the planar sharpening surface is substantially constant when the device is moved along the rod.

2. The method of claim 1 further comprising moving the device across the planar sharpening surface of the sharpening tool.

3. A sharpening guide assembly for sharpening a blade held in a device, the assembly comprising:

a sharpening tool including metal and having a substantially planer sharpening surface;

a body portion adapted to receive the sharpening tool;

a magnet disposed within the body portion for removably coupling the body portion to the sharpening tool; and a rod having a top edge, the rod fixedly attached to the body portion, the top edge of the rod being substantially parallel to the planar sharpening surface of the sharpening tool, the rod arranged such that the device is slidably couplable to the rod whereby the device is slidable along the rod such that the angle of the blade with respect to the planar sharpening surface is substantially constant when the device is moved along the rod and the blade is moved across the planar sharpening surface.

4. The sharpening guide assembly of claim 3 wherein the body portion includes a platform adapted to receive an end portion of the sharpening tool.

5. The sharpening guide assembly of claim 4 wherein the body portion includes a guide rail adjacent to the platform.

6. The sharpening guide assembly of claim 3 wherein the body includes a first cavity in which the magnet is disposed.

7. The sharpening guide assembly of claim 3 wherein the body comprises injection molded plastic.

8. The sharpening guide assembly of claim 3 wherein the magnet is a Neodymium Iron Boron magnet.

9. A sharpening guide assembly for sharpening a blade, comprising:

a sharpening tool including metal and having a substantially planer sharpening surface;

a body portion adapted to receive the sharpening tool;

a magnet disposed within the body portion for removably coupling the body portion to the sharpening tool;

a rod having a top edge and fixedly attached to the body portion, the top edge of the rod being substantially parallel to the planar sharpening surface of the sharpening tool; and a clamping device for holding the blade, the clamping device being slidably couplable to the rod whereby the clamping device is slidable along the rod such that the angle of the blade with respect to the planar sharpening surface is substantially constant when the clamping device is moved along the rod and the blade is moved across the planar sharpening surface.

10. The sharpening guide assembly of claim 9 wherein the body portion includes a platform adapted to receive an end portion of the sharpening tool.

11. The sharpening guide assembly of claim 10 wherein the body portion includes a guide rail adjacent to the platform.

12. The sharpening guide assembly of claim 9 wherein the body includes a first cavity in which the magnet is disposed.

13. The sharpening guide assembly of claim 9 wherein the body comprises injection molded plastic.

14. The sharpening guide assembly of claim 9 wherein the magnet is a Neodymium Iron Boron magnet.

15. The sharpening guide assembly of claim 9 wherein the clamping device includes a loop opening capable of receiving the rod and slidable along the rod.

16. The sharpening guide assembly of claim 9 wherein the clamping device comprises a first angle adjustment rod including an opening capable of receiving the rod and slidable along the rod, the first angle adjustment rod being substantially perpendicular to a length of the clamping device coplanar with the blade.

17. The sharpening guide assembly of claim 16 wherein the first adjustment rod includes a groove capable of engaging a notch formed in the clamping device.

18. The sharpening guide assembly of claim 17 wherein the first adjustment rod includes a plurality of grooves along a length of the first adjustment rod.

19. The sharpening guide assembly of claim 16 further comprising a second adjustment rod disposed oppositely with respect to the length of the clamping device.

* * * * *